US010692647B2

(12) United States Patent
Kan et al.

(10) Patent No.: US 10,692,647 B2
(45) Date of Patent: Jun. 23, 2020

(54) COIL COMPONENT

(71) Applicant: TDK CORPORATION, Tokyo (JP)

(72) Inventors: Masaki Kan, Tokyo (JP); Han Wu, Tokyo (JP)

(73) Assignee: TDK CORPORATION, Tokyo (JP)

( * ) Notice: Subject to any disclaimer, the term of this patent is extended or adjusted under 35 U.S.C. 154(b) by 168 days.

(21) Appl. No.: 16/021,758

(22) Filed: Jun. 28, 2018

(65) Prior Publication Data

US 2019/0006090 A1 Jan. 3, 2019

(30) Foreign Application Priority Data

Jun. 29, 2017 (JP) ..... 2017-126899

(51) Int. Cl.
*H01F 27/32* (2006.01)
*H01F 27/28* (2006.01)
(Continued)

(52) U.S. Cl.
CPC ..... *H01F 27/325* (2013.01); *H01F 27/2847* (2013.01); *H01F 27/303* (2013.01);
(Continued)

(58) Field of Classification Search
CPC .. H01F 27/325; H01F 27/2847; H01F 27/306; H01F 27/303; H01F 27/32;
(Continued)

(56) References Cited

U.S. PATENT DOCUMENTS 6,522,233 B1 * 2/2003 Kyoso ..... H01F 27/306 336/192
7,924,133 B2 * 4/2011 Kaneko ..... H01F 27/325 336/198
(Continued)

FOREIGN PATENT DOCUMENTS

CN 102074337 5/2011
CN 202332539 7/2012
(Continued)

OTHER PUBLICATIONS

Chinese Office Action, Chinese Patent Office, Application No. 201810637085.2, dated Apr. 2, 2020, with English translation thereof.

*Primary Examiner* — Mang Tin Bik Lian
(74) *Attorney, Agent, or Firm* — Greenblum & Bernstein, P.L.C.

(57) ABSTRACT

A coil component includes a non-conductive bobbin and a coil that winds around the bobbin. The coil includes first and second coil members with joining portions in which joining holes are formed. The bobbin includes first and second bobbin members. The first bobbin member includes: first and second positioning portions that position the first and second coil members, respectively, when the first and second coil members are moved onto the first bobbin member; and a support that supports lower portions of the first and second joining portions. The second bobbin member includes a first insulator disposed between the first and second coil members. The first and second coil members and the second
(Continued)

bobbin member are attached to the first bobbin member by being moved in a single direction without a further step of rotating.

20 Claims, 11 Drawing Sheets

(51) Int. Cl.
*H01F 27/30* (2006.01)
*H01F 5/02* (2006.01)

(52) U.S. Cl.
CPC ..... *H01F 27/306* (2013.01); *H01F 5/02* (2013.01); *H01F 2027/2861* (2013.01)

(58) Field of Classification Search
CPC .. H01F 27/323; H01F 27/324; H01F 27/2852; H01F 2027/2861; H01F 5/02; H01F 5/06
USPC ..... 336/198, 208, 212, 220–222
See application file for complete search history.

(56) References Cited

U.S. PATENT DOCUMENTS

| | | | | |
|---|---|---|---|---|
| 8,947,190 | B2 * | 2/2015 | Park | H01F 27/2804 336/170 |
| 10,210,990 | B2 | 2/2019 | Chou et al. | |
| 2010/0039204 | A1 * | 2/2010 | Kaneko | H01F 27/306 336/185 |
| 2012/0257419 | A1 * | 10/2012 | Kaneko | H01F 27/306 363/15 |
| 2012/0257420 | A1 * | 10/2012 | Kaneko | H01F 27/2847 363/21.04 |
| 2014/0240070 | A1 * | 8/2014 | Ikezawa | H01F 27/306 336/198 |

FOREIGN PATENT DOCUMENTS

| | | |
|---|---|---|
| CN | 103515067 | 1/2014 |
| CN | 203444947 | 2/2014 |
| CN | 205542333 | 8/2016 |
| JP | 5273192 | 5/2013 |
| KR | 20140004847 | 1/2014 |

* cited by examiner

COIL COMPONENT

FIELD OF THE INVENTION

The present invention relates to a coil component equipped with a bobbin and a coil that winds around the bobbin.

DESCRIPTION OF THE RELATED ART

A coil component disclosed by the present applicant in Patent Literature 1 (Japanese Patent No. 5,273,192 (See Pages 4 to 9, and FIGS. 7, 8, and 10)) is known as one example of this type of coil component. This coil component includes a coil bobbin, a first coil winding, a second coil winding, and a screw as a connection member. When the coil component is assembled, the rear surface of the first coil winding and one end of the coil bobbin are placed facing one another and then projecting portions provided on the same end of the coil bobbin and notches provided in the first coil winding are aligned. After this, one end of a barrel of the coil bobbin is inserted into an opening provided in the first coil winding. At this time, the projecting portions of the coil bobbin are inserted through the notches of the first coil winding. Next, the first coil winding is rotated relative to the coil bobbin in a state where a flange of the coil bobbin is in contact with a rear surface of the first coil winding. At this time, the projecting portions of the coil bobbin engage the edge of the first coil winding so that the coil bobbin and the first coil winding are fixed in a positioned state. By doing so, the first coil winding is assembled on the coil bobbin. Next, the rear surface of the second coil winding and the other end of the coil bobbin are placed facing one another, and then projecting portions provided at the other end of the coil bobbin and notches provided in the second coil winding are aligned. The other end of the barrel of the coil bobbin is then inserted into an opening of the second coil winding. When doing so, the projecting portions of the coil bobbin are inserted through the notches of the second coil winding. After this, the second coil winding is rotated relative to the coil bobbin in a state where a flange of the coil bobbin is in contact with a rear surface of the second coil winding. At this time, the projecting portions of the coil bobbin engage the edge of the second coil winding so that the coil bobbin and the second coil winding are fixed in a positioned state. By doing so, the second coil winding is assembled on the coil bobbin. Next, a terminal provided on the first coil winding and a terminal provided on the second coil winding are joined by a screw to electrically connect the terminals. By doing so, the coil component is assembled.

SUMMARY OF THE INVENTION

However, the coil component described above has the following problem to be solved. More specifically, when assembling the coil component described above, it is necessary to insert one end of the barrel of the coil bobbin into the opening in the first coil winding and to insert the other end of the barrel of the coil bobbin into the opening in the second coil winding (that is, to insert the barrel of the coil bobbin from different directions into the respective openings of the coil windings) and to rotate the coil windings with respect to the coil bobbin to fix the coil bobbin and the coil windings in the positioned state, which makes the assembly process complex. Further, since the assembly process (in particular, the step of rotating the coil windings) is complex, it is difficult to automate assembly using robots and therefore difficult to improve the assembly efficiency. Also, when assembling the coil component, a terminal of the first coil winding and a terminal of the second coil winding are connected by a screw. With this configuration, when the screw is tightened, the terminals may become shaved by the screw to produce chips or burrs, and when these chips or burrs fall off onto a circuit board or the like on which the coil component has been incorporated, this can cause electrical shorting.

The present invention was conceived in view of the problem described above and has a principal object of providing a coil component capable of improving assembly efficiency and preventing electrical shorting.

To achieve the stated object, a coil component according to the present invention comprises: a non-conductive bobbin; and a coil that winds around the bobbin, wherein the coil includes: a first coil member with a first main body, which is formed in one of an arc shape and a spiral shape, and a first joint, which is provided at one end of the first main body and in which a first joining hole is formed; and a second coil member with a second main body, which is formed in one of an arc shape and a spiral shape, and a second joint, which is provided at one end of the second main body and in which a second joining hole is formed, wherein the second coil member is electrically connected to the first coil member via a screw that is inserted through the first and second joining holes of the first and second joints, the bobbin includes a first bobbin member and a second bobbin member, the first bobbin member includes: a base plate that has a first opening formed in a central portion thereof; a barrel that is erected on the base plate so as to connect to the first opening; a first positioner that positions the first coil member when the first coil member is moved along a center axis of the barrel from a front end of the barrel toward the base plate; a second positioner that positions the second coil member when the second coil member is moved along the center axis from the front end of the barrel toward the base plate; and a support that is provided on the base plate and is formed so as to surround and support lower portions of the first and second joints of the first and second coil members, the second bobbin member includes a first insulator that is plate-shaped, has a second opening formed in a central portion thereof, and is disposed between the first and second coil members to insulate the first and second coil members from each other, the first coil member is positioned by the first positioner in a state where the barrel is inserted through the first main body and the first coil member is disposed on the base plate, and the first joint is supported by the support, the first insulator is disposed on the first coil member in a state where the barrel has been inserted through the second opening, and the second coil member is positioned by the second positioner in a state where the barrel is inserted through the second main body and the second coil member is disposed on the first insulator, and the second joint is supported by the support.

Also, in the coil component according to the present invention, the second bobbin member includes a second insulator that is plate-shaped and has a third opening in a central portion thereof, and the second insulator is disposed on the second coil member in a state where the barrel has been inserted through the third opening.

Also, in the coil component according to the present invention, the first and second insulators face each other at a distance and are integrated due to parts of edges of the first and second insulators being connected by a side wall.

Also, in the coil component according to the present invention, the second main body is formed in a spiral shape and has two rings that face each other at a distance, and the second bobbin member includes a non-conductive holder that is formed in a flange shape that protrudes from an inner surface of the side wall, is inserted between the rings, and holds the rings in a separated state.

Also, in the coil component according to the present invention, the support functions as the first positioner and the second positioner.

Also, the coil component according to the present invention further comprises: a first core that has a first pillar inserted into a base end side of the barrel; and a second core that has a second pillar inserted into the front end side of the barrel, wherein the first bobbin member includes a third positioner that positions the first core.

Also, in the coil component according to the present invention, the second bobbin member includes a fourth positioner that positions the second core.

Also, in the coil component according to the present invention, the third positioner positions the second core.

With the above coil component according to the present invention, by providing the first bobbin member with the first positioner that positions the first coil member when the first coil member is moved along a center axis of the barrel from the front end of the barrel toward the base plate and the second positioner that positions the second coil member when the second coil member is moved along the center axis from the front end of the barrel toward the base plate, it is possible to position the respective coil members with respect to the first bobbin member by merely moving the coil members in a single direction (i.e., from the front end of the barrel toward the base plate). This means that according to the above coil component, compared to a conventional configuration that inserts the barrel of the coil bobbin into the two coil windings from different directions and positions the coil bobbin and the respective coil windings by rotating the coil windings with respect to the coil bobbin, it is possible to sufficiently simplify the assembly process. Since the assembly process is simplified, it is possible to automate the assembly using a robot, and as a result, it is possible to sufficiently improve the assembly efficiency. Also, according to the above coil component, by equipping the first bobbin member with the support that is formed so as to be capable of surrounding and supporting lower portions of the respective joints of the coil members, even if chips and burrs are produced by screwing a screw into the first joining hole when joining the first joint of the first coil member and the second joint of the second coil member, it is possible to reliably catch the chips and burrs using the support. This means that according to the above coil component, it is possible to reliably avoid a situation where chips and burrs fall onto electric circuits or the like on which the coil component is incorporated and cause electrical shorting.

It should be noted that the disclosure of the present invention relates to the contents of Japanese Patent Application No. 2017-126899 that was filed on Jun. 29, 2017, the entire contents of which are herein incorporated by reference.

BRIEF DESCRIPTION OF THE DRAWINGS

These and other objects and features of the present invention will be explained in more detail below with reference to the attached drawings, wherein.

DESCRIPTION OF THE PREFERRED EMBODIMENTS

Preferred embodiments of a coil component will now be described with reference to the attached drawings.

Figure 1:
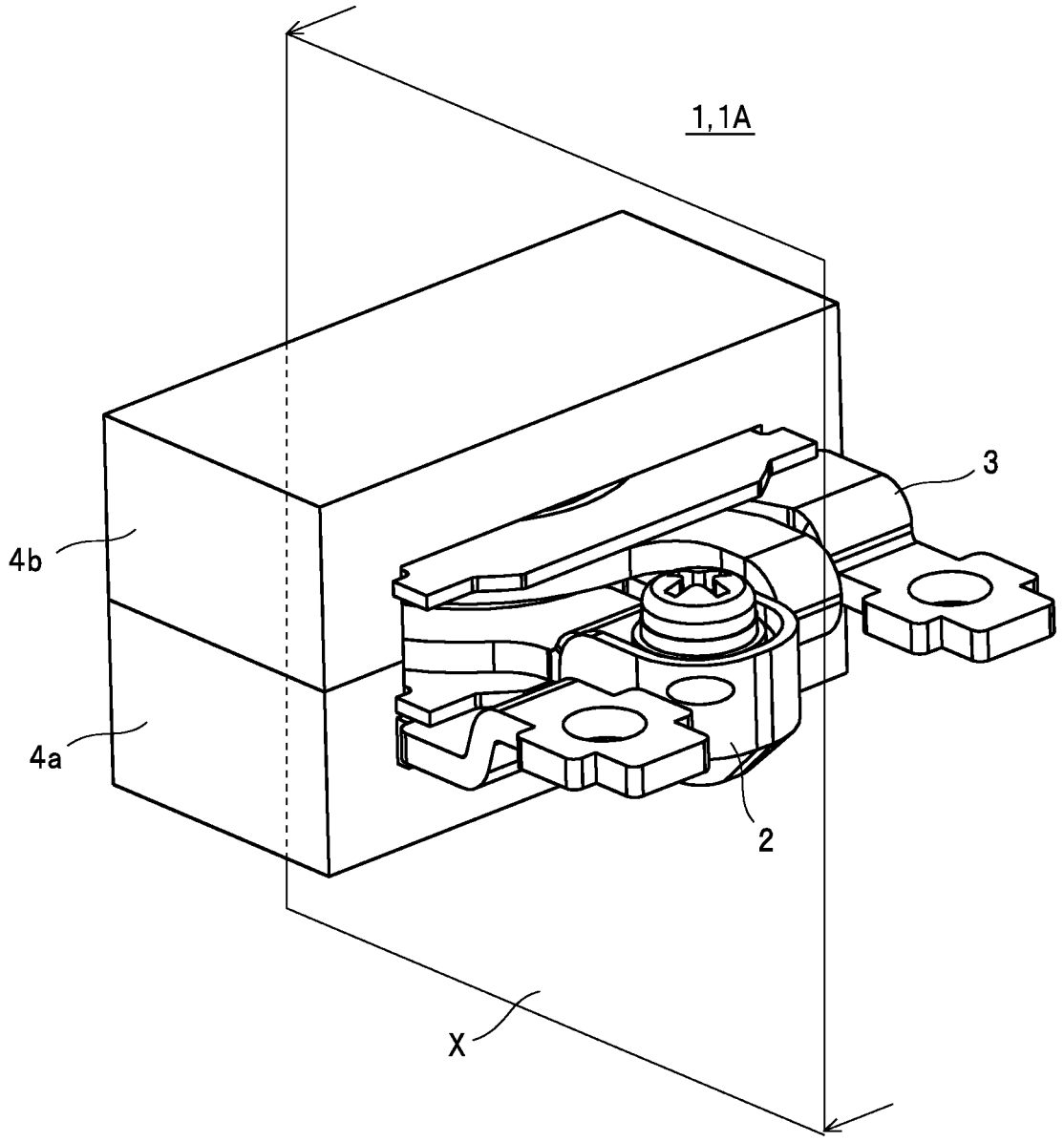
FIG. 1 is a perspective view of a coil component 1 or 101.
Figure 2:
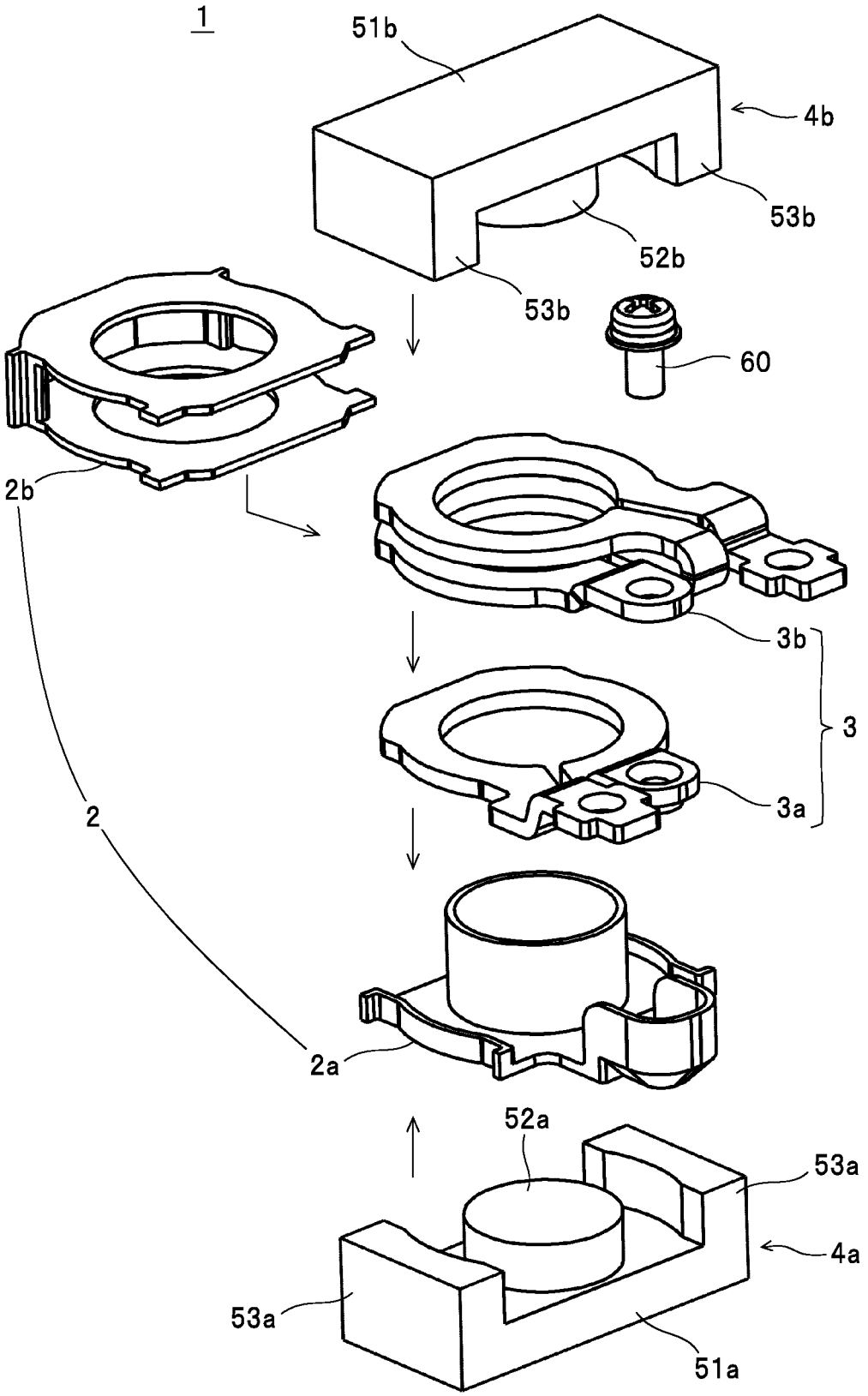
FIG. 2 is an exploded perspective view of a coil component 1.

First, the configuration of a coil component 1 depicted in FIG. 1 will be described as an example of a coil component. The coil component 1 is an electrical component to be used in a switching power supply, for example, and as depicted in FIG. 1 and FIG. 2, includes a bobbin 2, a coil 3, and cores 4*a* and 4*b*. Note that a component composed of the bobbin 2 and the coil 3 without the cores 4*a* and 4*b* is also included in the intended meaning of the expression "coil component" used here.

As depicted in FIG. 2, the bobbin 2 includes a first bobbin member 2*a* (one example of a "first bobbin member" for the present invention) and a second bobbin member 2*b* (one example of a "second bobbin member" for the present invention).

Figure 3:
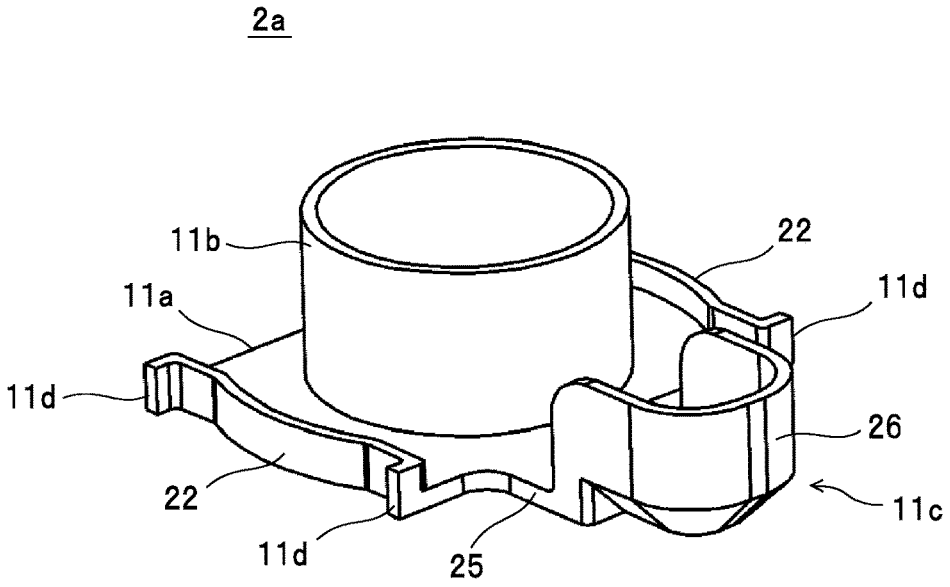
FIG. 3 is a perspective view of a first bobbin member 2*a;*
Figure 4:
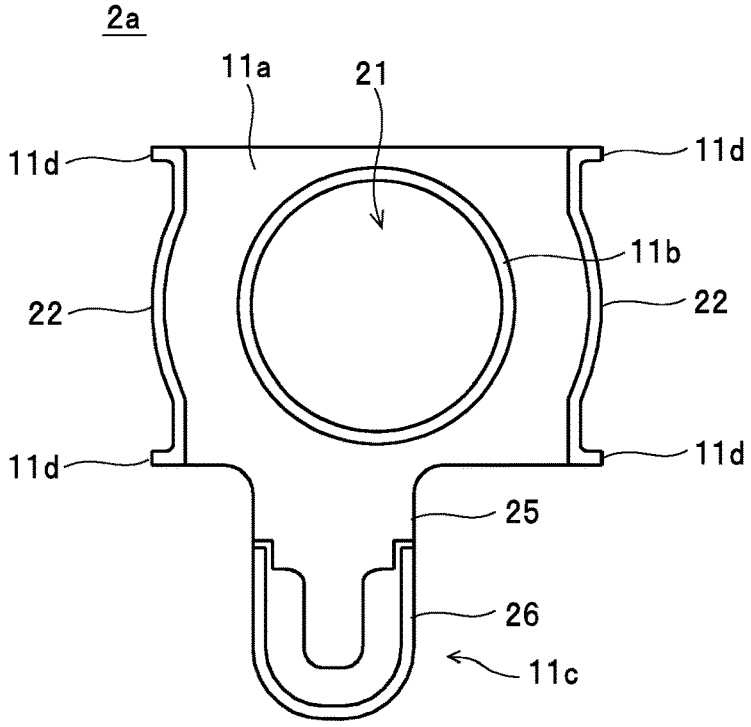
FIG. 4 is a plan view of the first bobbin member 2*a;*

As depicted in FIGS. 3 and 4, the first bobbin member 2*a* includes a base plate 11*a*, a barrel 11*b*, a support 11*c*, and four projecting portions 11*d*, which are integrally formed using a non-conductive material (such as resin).

As depicted in FIG. 4, the base plate 11*a* is formed in a plate-like shape that has a circular opening 21 (or "first opening") in a central portion thereof. As depicted in FIGS. 3 and 4, walls 22 are erected along two facing edges of the base plate 11*a*. The barrel 11*b* is formed in a barrel shape and is erected on the base plate 11*a* so as to connect to the opening 21 of the base plate 11*a*.

As depicted in FIGS. 3 and 4, the support 11*c* includes a base 25 that extends from the base plate 11*a* on the same plane as the base plate 11*a* and a wall 26 that is U-shaped for example when looking from above and is erected on the base 25. The support 11*c* surrounds and supports lower portions of a joining portion 43*a* (one example of a "first joint" for the present invention) of a first coil member 3*a*, described later, and a joining portion 43*b* (one example of a "second joint" for the present invention) of the second coil member 3*b* that construct the coil 3. More specifically, the support

Figure 11:
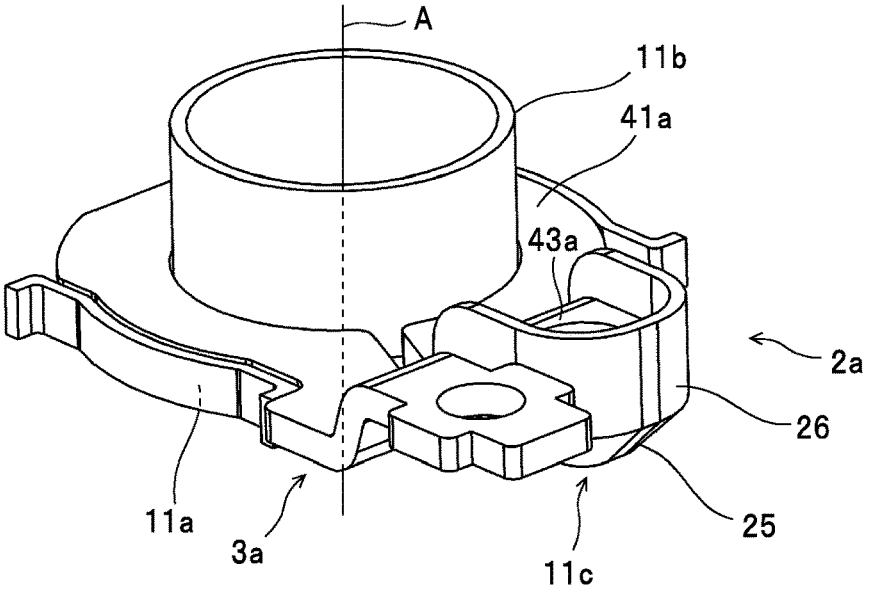
FIG. 11 is a first diagram useful in explaining a method of assembling the coil component 1.
Figure 14:
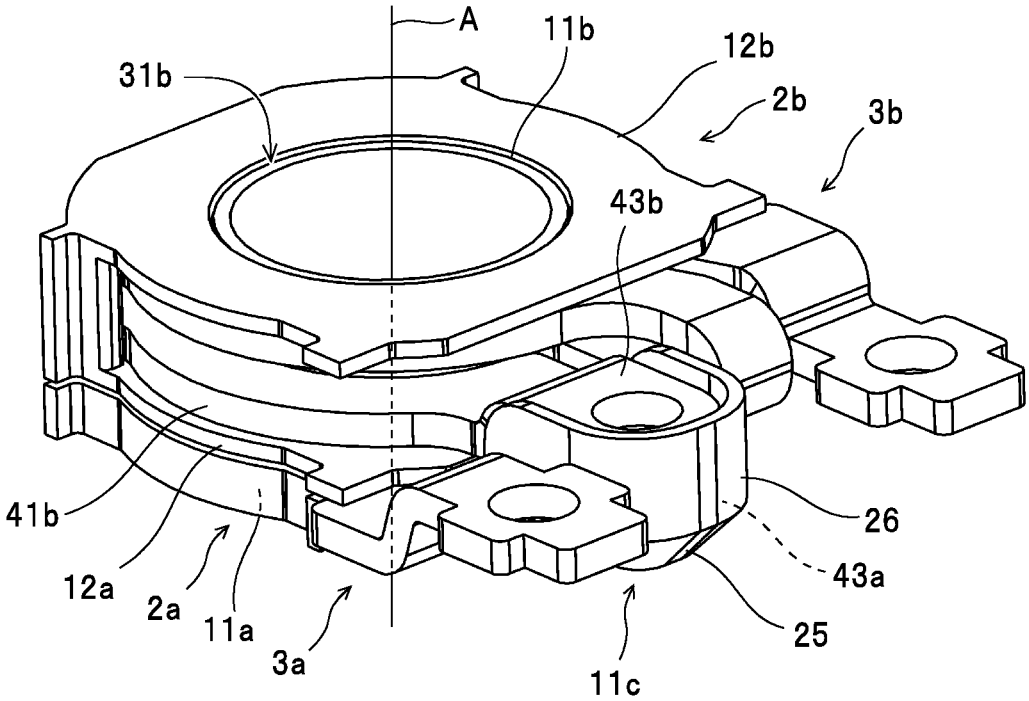
FIG. 14 is a fourth diagram useful in explaining a method of assembling the coil component 1.

11*c* supports a lower surface of the connecting portion 43*a* and a side surface of the connecting portion 43*b* (see FIGS. 11 and 14). The support 11*c* also functions as a first positioner that positions the first coil member 3*a* and a second positioner that positions the second coil member 3*b*. Also, as depicted in FIGS. 11 and 14, the support 11*c* is formed at a position set so that the joining portions 43*a* and 43*b* fit and are positioned inside the wall 26 when the first coil member 3*a* and the second coil member 3*b* are moved along a center axis A of the barrel 11*b* from a front end of the barrel 11*b* toward the base plate 11*a*. Note that the shape of the support 11*c* is not limited to the shape described above and it is possible to use various shapes, such as a shape where the wall is U shaped when viewed from above and a shape where the support 11*c* as a whole is hemispherical.

As depicted in FIGS. 3 and 4, the projecting portions 11*d* are formed so as to protrude from both ends of the walls 22 erected on the base plate 11*a*. The projecting portions 11*d* function as third positioners that position the core 4*a*.

Figure 5:
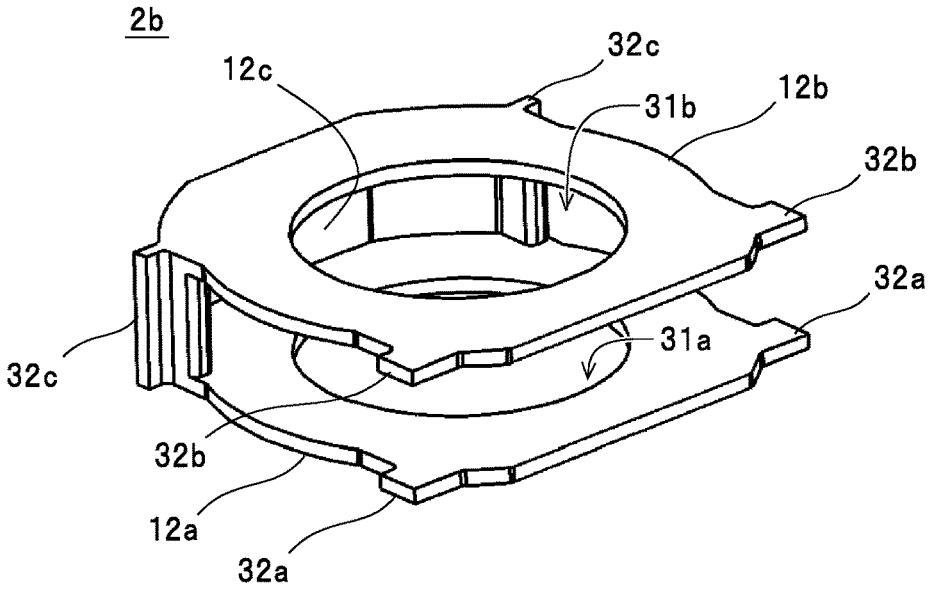
FIG. 5 is a perspective view of a second bobbin member 2*b;*
Figure 6:
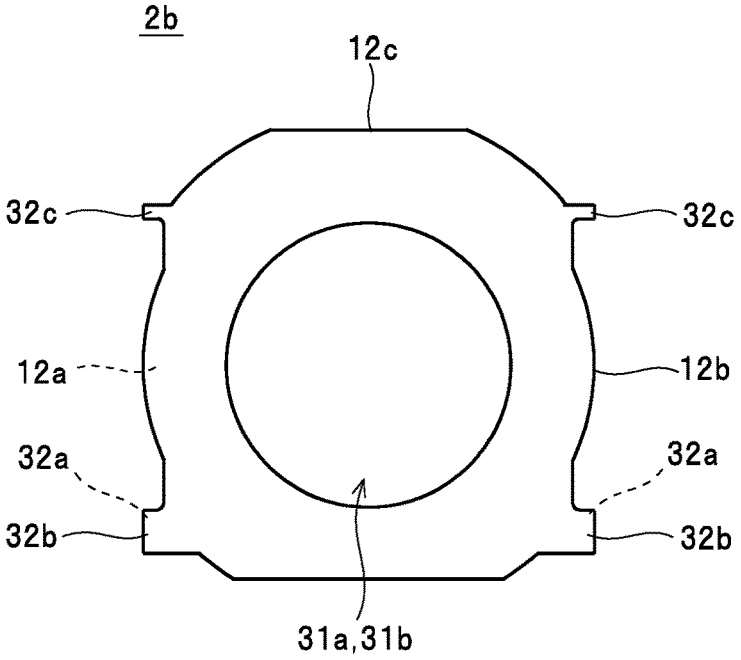
FIG. 6 is a plan view of the second bobbin member 2*b;*

As depicted in FIGS. 5 and 6, the second bobbin member 2*b* includes insulating plates 12*a* and 12*b* and a side wall 12*c*, which are integrally formed of a non-conductive material (such as resin) to form a U shape when looking from the side.

The insulating plate 12*a* corresponds to a "first insulator" for the present invention, and as depicted in FIGS. 5 and 6, is formed in a plate-like shape with an opening 31*a* (or "second opening" for the present invention) in a central portion thereof. Two projecting portions 32*a* are formed on the insulating plate 12*a*.

The insulating plate 12*b* corresponds to a "second insulator" for the present invention, and as depicted in FIGS. 5 and 6, is formed in a plate-like shape with an opening 31*b* (or "third opening" for the present invention) in a central portion thereof. Two projecting portions 32*b* are formed on the insulating plate 12*b*.

As depicted in FIGS. 5 and 6, the side wall 12*c* is formed in a plate-like shape and connects parts of the edges of the insulating plates 12*a* and 12*b* that face each other at a distance. Two projecting portions 32*c* are formed on the side wall 12*c*. The projecting portions 32*a*, 32*b*, and 32*c* described above function as "fourth positioner" that position the core 4*b*.

The second bobbin member 2*b* is disposed above the first coil member 3*a* with the barrel 11*b* of the first bobbin member 2*a* inserted through the openings 31*a* and 31*b* of the insulating plates 12*a* and 12*b* (see FIG. 14) in a state where the second coil member 3*b* of the coil 3, described later, is sandwiched by the second bobbin member 2*b*. The insulating plate 12*a* functions so as to insulate the first coil member 3*a* and the second coil member 3*b* from each other and the insulating plate 12*b* functions so as to insulate the second coil member 3*b* and the core 4*b* from each other.

As depicted in FIG. 2, the coil 3 is composed of the first coil member 3*a* (one example of the "first coil member" for the present invention) and the second coil member 3*b* (one example of the "second coil member" for the present invention) and winds around the bobbin 2.

Figure 7:
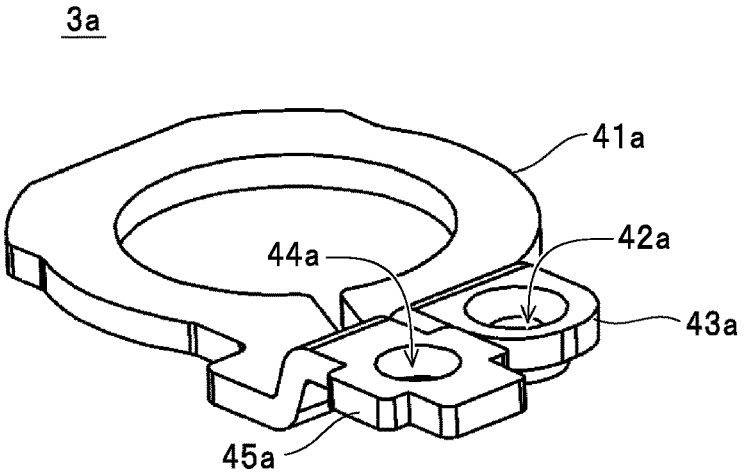
FIG. 7 is a perspective view of a first coil member 3*a;*
Figure 8:
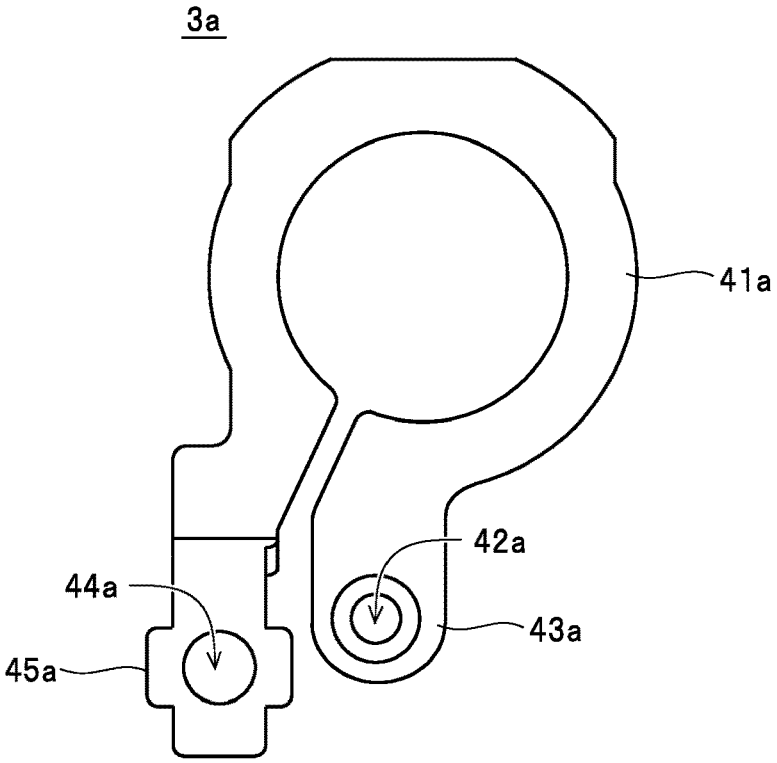
FIG. 8 is a plan view of the first coil member 3*a;*

As depicted in FIGS. 7 and 8, the first coil member 3*a* includes a main body 41*a* (one example of a "first main body" for the present invention) that is substantially arc-shaped (a shape where a slit is provided in part of a ring), a joining portion 43*a* provided at one end of the main body 41*a* (the right end in FIGS. 7 and 8), and a connector 45*a* provided on the other end of the main body 41*a* (the left end in FIGS. 7 and 8), and is formed of a conductive material (for example, copper). A screw hole 42*a* (one example of a "first joining hole" for the present invention) into which a screw 60 depicted in FIG. 2 is screwed is formed in the joining portion 43*a*. An insertion through-hole 44*a* through which a screw, not illustrated, used when connecting to an external connected object (such as a connection terminal) passes is formed in the connector 45*a*.

Figure 9:
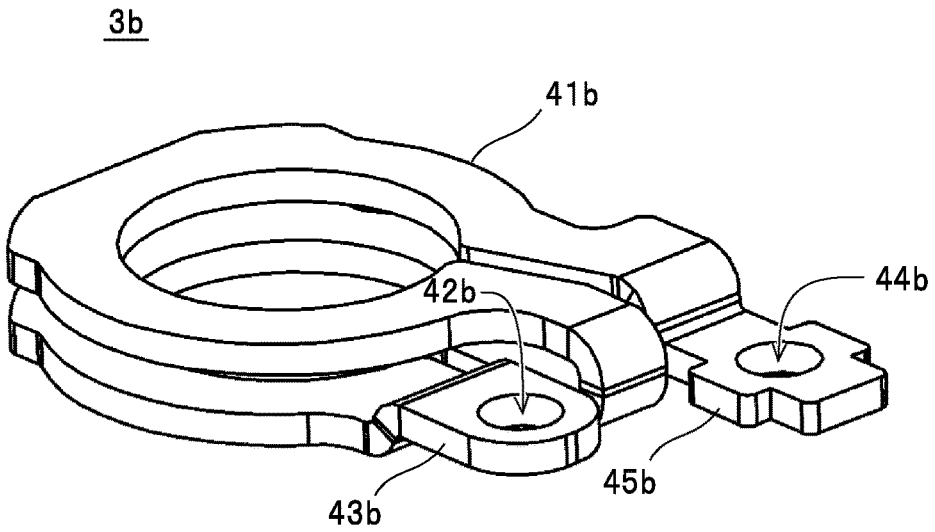
FIG. 9 is a perspective view of a second coil member 3*b;*
Figure 10:
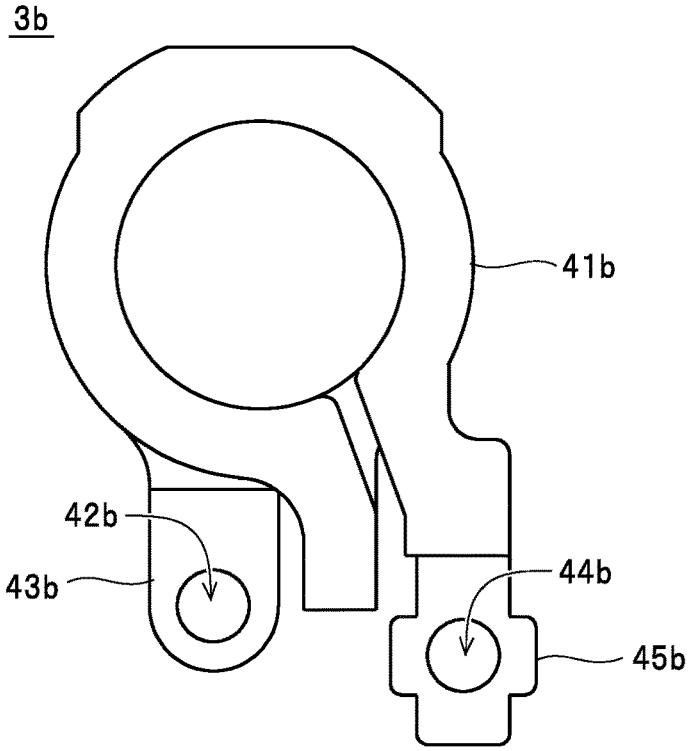
FIG. 10 is a plan view of the second coil member 3*b;*

As depicted in FIGS. 9 and 10, the second coil member 3*b* includes a main body 41*b* (one example of a "second main body" for the present invention) that is spirally shaped (that is, a shape produced by ring-shaped parts that have slits and overlap each other), a joining portion 43*b* provided at one end of the main body 41*b* (the left end in FIGS. 9 and 10), and a connector 45*b* provided on the other end of the main body 41*b* (the right end in FIGS. 9 and 10), and is formed of a conductive material (for example, copper that is the same material as the first coil member 3*a*). An insertion through-hole 42*b* (one example of a "second joining hole" for the present invention) through which the screw 60 depicted in FIG. 2 can be inserted is formed in the joining portion 43*b*. An insertion through-hole 44*b* through which a screw, not illustrated, used when connecting to an external connected object (such as a connection terminal) passes is formed in the connector 45*b*.

Figure 16:
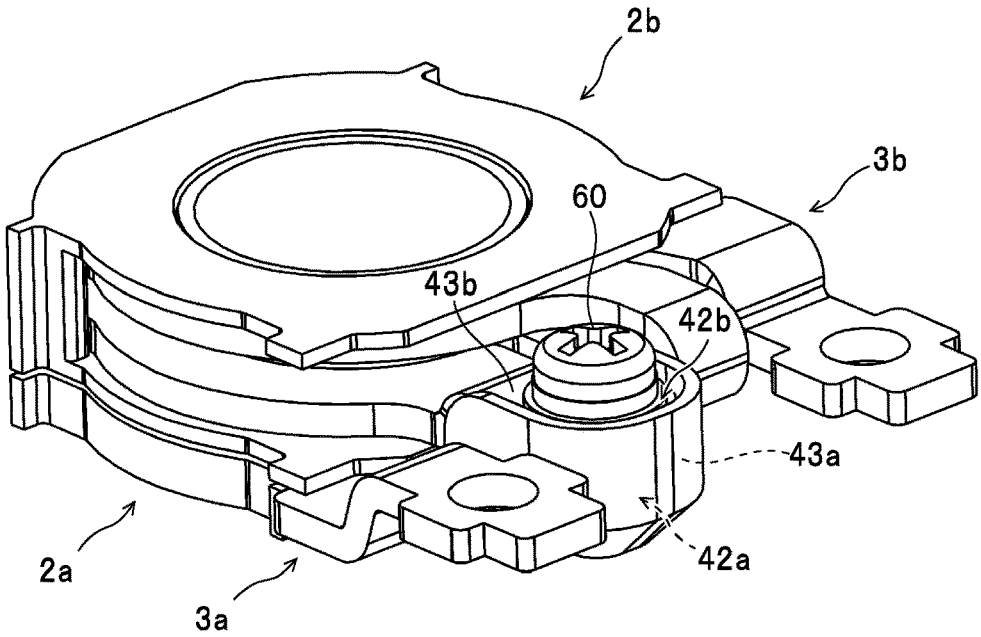
FIG. 16 is a sixth diagram useful in explaining a method of assembling the coil component 1.

The first coil member 3*a* and the second coil member 3*b* construct the spiral coil 3 (see FIG. 2) winding around the barrel 11*b* of the first bobbin member 2*a* in a state where the first coil member 3*a* and the second coil member 3*b* are electrically connected via the screw 60 that has been inserted through (i.e., screwed into) the screw hole 42*a* of the joining portion 43*a* and the insertion through-hole 42*b* of the connecting portion 43*b* (see FIG. 16).

Figure 18:
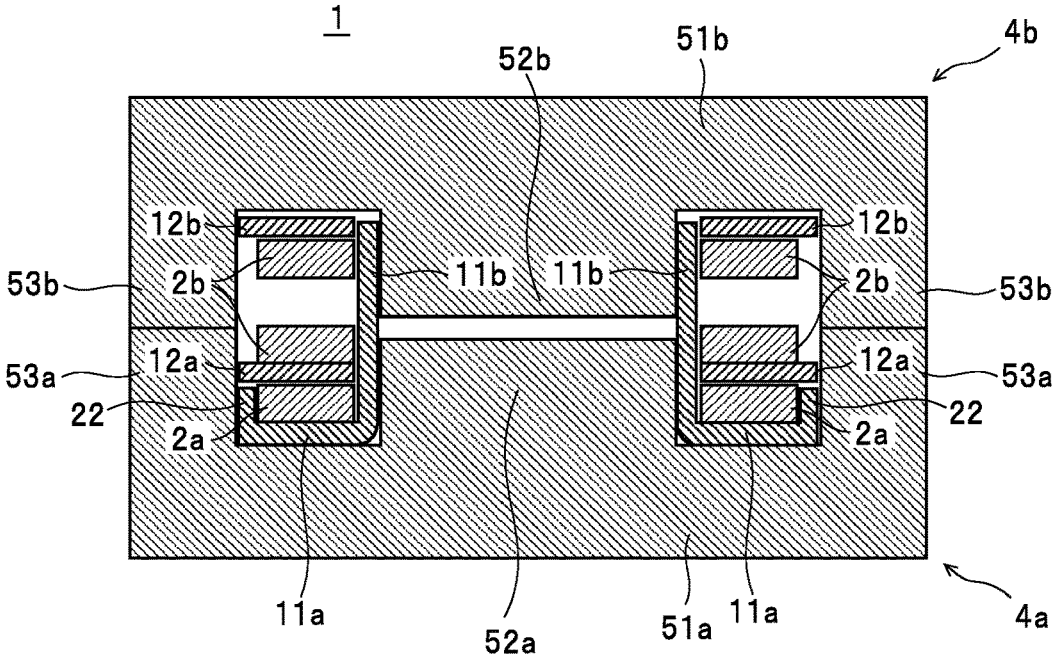
FIG. 18 is an eighth diagram useful in explaining a method of assembling the coil component 1.

The core 4*a* corresponds to a "first core" for the present invention. As depicted in FIG. 2, the core 4*a* includes a plate-like portion 51*a*, a pillar-like portion 52*a* (one example of a "first pillar" for the present invention), and two side portions 53*a*, and is formed of a magnetic material. The core 4*b* corresponds to a "second core". As depicted in FIG. 2, the core 4*b* includes a plate-like portion 51*b*, a pillar-like portion 52*b* (one example of a "second pillar" for the present invention), and two side portions 53*b*, and is formed in the same shape as the core 4*a*. With the present configuration, as depicted in FIG. 18, the core 4*a* is disposed on the base plate 11*a* side of the first bobbin member 2*a* in a state where the pillar-like portion 52*a* has been inserted into a base end side (the lower side in FIG. 18) of the barrel 11*b* of the first bobbin member 2*a*. The core 4*b* is disposed on the insulating plate 12*b* side of the second bobbin member 2*b* in a state where the pillar-like portion 52*b* has been inserted into the front end side of the barrel 11*b* (the upper side in FIG. 18).

Next, a method of assembling the coil component 1 will be described with reference to the drawings.

Figure 12:
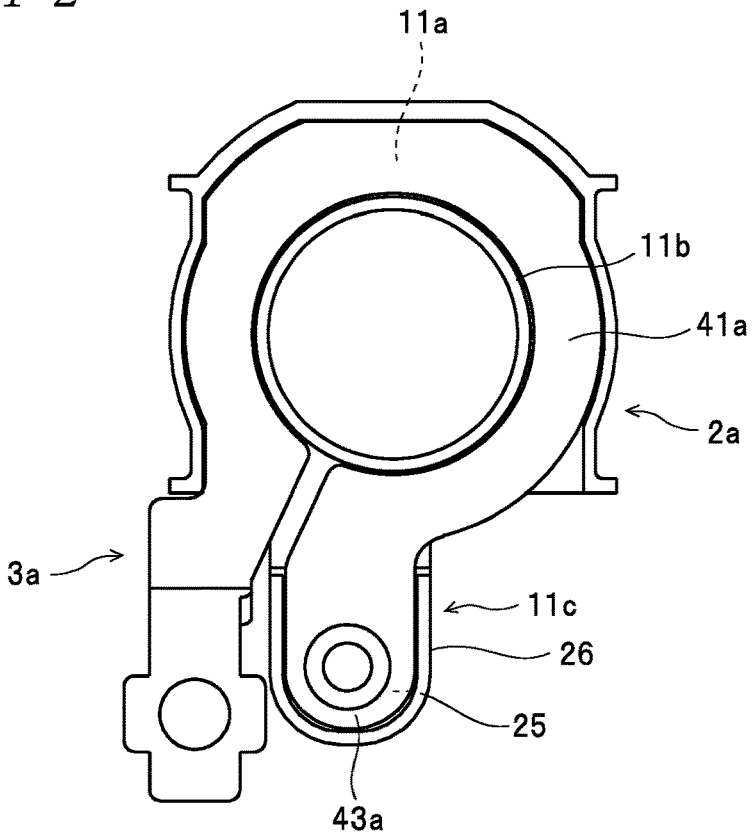
FIG. 12 is a second diagram useful in explaining a method of assembling the coil component 1.

First, as depicted in FIGS. 11 and 12, the front end (the upper end in FIGS. 11 and 12) of the barrel 11*b* of the first bobbin member 2*a* that constructs the bobbin 2 is inserted through the main body 41*a* of the first coil member 3*a* that constructs the coil 3, the joining portion 43*a* of the first coil member 3*a* is then positioned above the support 11*c* of the first bobbin member 2*a*, and after this, the first coil member 3*a* is moved along the center axis A of the barrel 11*b* from the front end of the barrel 11*b* toward the base plate 11*a* of the first bobbin member 2*a*. When doing so, the joining portion 43*a* fits inside the wall 26 of the support 11*c* so that the first coil member 3*a* is disposed on the base plate 11*a* of the first bobbin member 2*a*.

With this configuration, by fitting the joining portion 43*a* of the first coil member 3*a* inside the wall 26 of the support 11*c* of the first bobbin member 2*a*, a lower portion of the joining portion 43*a* (i.e., the lower surface and the side surface) becomes supported in a state where the lower portion is surrounded by the base 25 and the wall 26 of the support 11*c*. By fitting the joining portion 43*a* inside the wall 26 of the support 11*c*, the first coil member 3*a* is positioned relative to the first bobbin member 2*a*.

Figure 13:
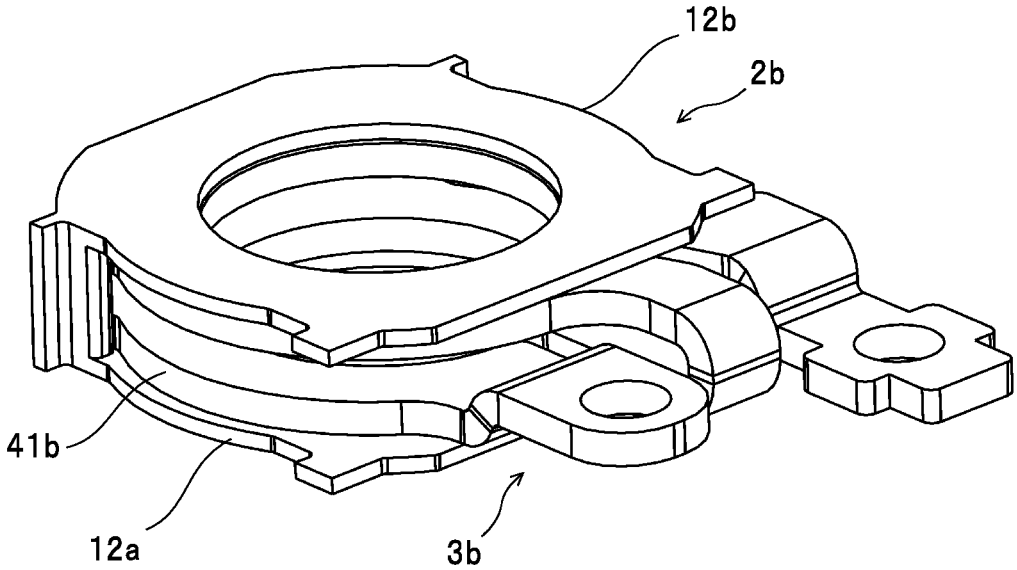
FIG. 13 is a third diagram useful in explaining a method of assembling the coil component 1.

Next, as depicted in FIG. 13, the main body 41*b* of the second coil member 3*b* that constructs the coil 3 is sandwiched by the insulating plates 12*a* and 12*b* of the second bobbin member 2*b* that constructs the bobbin 2.

Next, as depicted in FIG. 14, the front end of the barrel 11*b* of the first bobbin member 2*a* is inserted through the opening 31*a* of the insulating plate 12*a* of the second bobbin member 2*b* (see FIG. 5), the main body 41*b* of the second coil member 3*b*, and the opening 31*b* of the insulating plate 12*b* of the second bobbin member 2*b*, the joining portion 43*b* of the second coil member 3*b* is then positioned above the support 11*c* of the first bobbin member 2*a*, and after this, the second coil member 3*b* is moved together with the second bobbin member 2*b* along the center axis A of the barrel 11*b* from the front end of the barrel 11*b* toward the base plate 11*a* of the first bobbin member 2*a*. When doing so, the joining portion 43*b* fits inside the wall 26 of the support 11*c* and the second bobbin member 2*b* and the second coil member 3*b* are disposed on the first coil member 3*a*.

Figure 15:
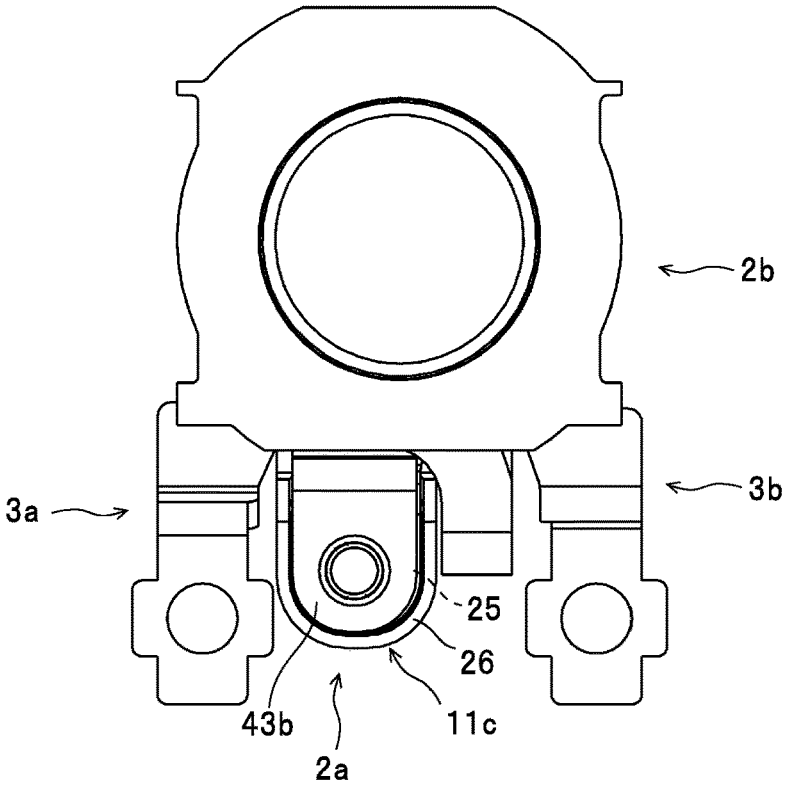
FIG. 15 is a fifth diagram useful in explaining a method of assembling the coil component 1.

Here, as depicted in FIGS. 14 and 15, by fitting the joining portion 43*b* of the second coil member 3*b* inside the wall 26 of the support 11*c* of the first bobbin member 2*a*, the lower portion of the joining portion 43*b* (that is, the lower surface and the side surface) becomes supported in a state where the lower portion is surrounded by the base 25 (more accurately, by the joining portion 43*a* of the first coil member 3*a* that is supported by the base 25) and the wall 26 of the support 11*c*. By fitting the joining portion 43*b* inside the wall 26 of the support 11*c*, the second coil member 3*b* is positioned relative to the first bobbin member 2*a*.

In the state where the barrel 11*b* has been inserted through the opening 31*a*, the insulating plate 12*a* is disposed on the first coil member 3*a* and insulates the first coil member 3*a* and the second coil member 3*b* from each other. In the state where the barrel 11*b* has been inserted through the opening 31*b*, the insulating plate 12*b* is disposed on the second coil member 3*b*.

Next, as depicted in FIG. 16, the front end of the screw 60 is inserted through the insertion through-hole 42*b* formed in the joining portion 43*b* of the second coil member 3*b* and then the screw 60 is screwed into the screw hole 42*a* formed in the joining portion 43*a* of the first coil member 3*a*. By doing so, the joining portions 43*a* and 43*b* are joined and the first coil member 3*a* and the second coil member 3*b* are electrically connected.

Figure 17:
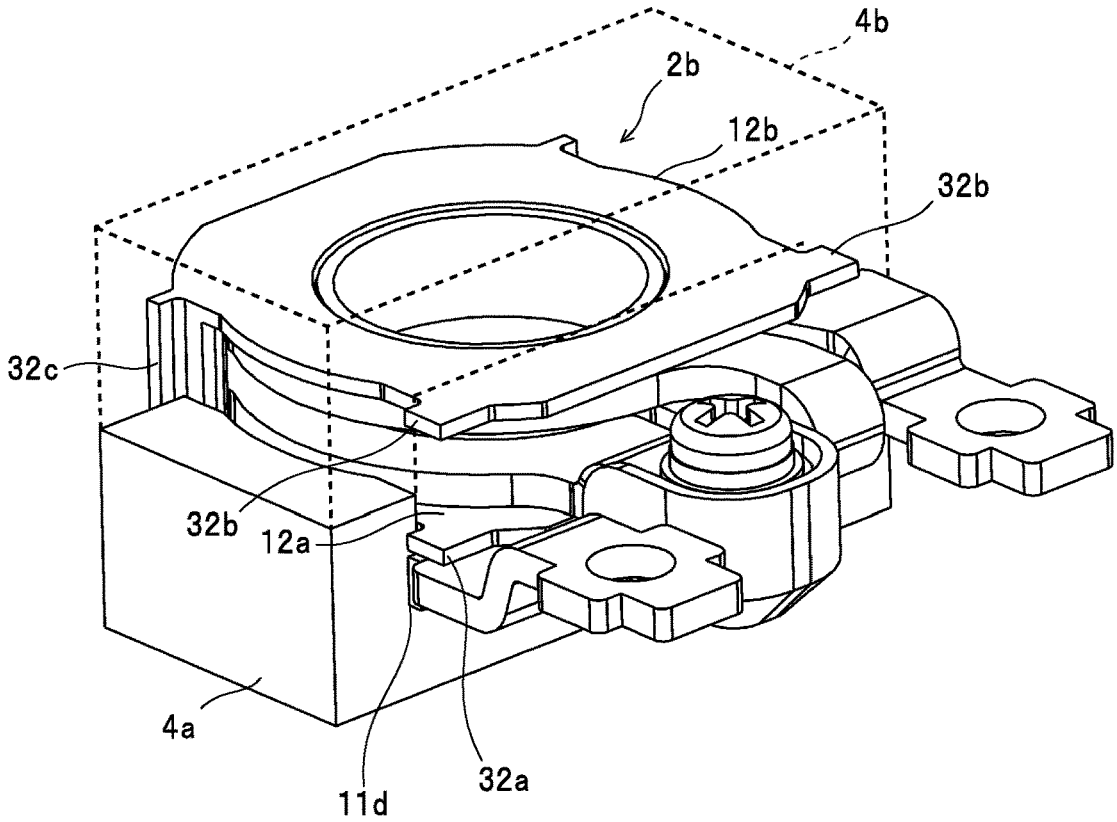
FIG. 17 is a seventh diagram useful in explaining a method of assembling the coil component 1.

Next, as depicted by the solid lines in FIG. 17, the core 4*a* is attached. More specifically, as depicted in FIG. 18, the pillar-like portion 52*a* of the core 4*a* is inserted from the base end side (the lower side in FIG. 18) of the barrel 11*b* of the first bobbin member 2*a* and the side portions 53*a* of the core 4*a* are fitted outside the walls 22 of the base plate 11*a* of the first bobbin member 2*a*. At this time, as depicted in FIG. 17, ends of the side portions 53*a* of the core 4*a* come into contact with the projecting portions 11*d* formed on the walls 22 so that the first coil member 3*a* is positioned with respect to the first bobbin member 2*a*. The ends of the side portions 53*a* of the core 4*a* also come into contact with the projecting portions 32*a* formed on the insulating plate 12*a* of the second bobbin member 2*b* and the projecting portions 32*c* formed on the side wall 12*c* of the second bobbin member 2*b*, and by doing so the first bobbin member 2*a* and the core 4*a* are positioned. In a state where the core 4*a* is attached, the base plate 11*a* of the first bobbin member 2*a* is interposed between the core 4*a* and the first coil member 3*a*, which means that the core 4*a* and the first coil member 3*a* are insulated from each other.

Next, as depicted by the broken lines in FIG. 17, the core 4*b* is attached. More specifically, as depicted in FIG. 18, the pillar-like portion 52*b* of the core 4*b* is inserted from the front end side (the upper side in FIG. 18) of the barrel 11*b* of the first bobbin member 2*a* and the side portions 53*b* of the core 4*b* are fitted outside the insulating plate 12*b* of the second bobbin member 2*b*. At this time, as depicted in FIG. 17, ends of the side portions 53*b* of the core 4*b* come into contact with the projecting portions 32*b* formed on the insulating plate 12*b* and the projecting portions 32*c* formed on the side wall 12*c* of the second bobbin member 2*b* so that the second bobbin member 2*b* and the core 4*b* are positioned. In a state where the core 4*b* is attached, the insulating plate 12*b* of the second bobbin member 2*b* is interposed between the core 4*b* and the second coil member 3*b*, which means that the core 4*b* and the second coil member 3*b* are insulated from each other. By performing the above processes, assembly of the coil component 1 is completed.

In this way, according to the coil component 1, by providing the support 11*c* on the first bobbin member 2*a* as a first positioner and the second positioner that are capable of positioning the coil members 3*a* and 3*b* when the coil members 3*a* and 3*b* are moved along the center axis A of the barrel 11*b* of the first bobbin member 2*a* from the front end of the barrel 11*b* toward the base plate 11*a* of the first bobbin member 2*a*, it is possible to position the coil members 3*a* and 3*b* relative to the first bobbin member 2*a* by merely moving the coil members 3*a* and 3*b* in one direction (that is, the direction from the front end of the barrel 11*b* toward the base plate 11*a*). This means that according to the coil component 1, compared to a conventional configuration that inserts the barrel of the coil bobbin into the two coil windings from different directions and positions the coil bobbin and the respective coil windings by rotating the coil windings with respect to the coil bobbin, it is possible to sufficiently simplify the assembly process. Since the assembly process is simplified, it is possible to automate the assembly using a robot, and as a result, it is possible to sufficiently improve the assembly efficiency. Also, according to the coil component 1, by equipping the first bobbin member 2*a* with the support 11*c* that is formed so as to be capable of surrounding and supporting lower portions of the joining portions 43*a* and 43*b* of the coil members 3*a* and 3*b*, even if chips and burrs are produced by screwing the screw 60 into the screw hole 42*a* when joining the joining portion 43*a* of the first coil member 3*a* and the joining portion 43*b* of the second coil member 3*b*, it is possible to reliably catch the chips and burrs using the support 11*c*. This means that according to the coil component 1, it is possible to reliably avoid a situation where chips and burrs fall onto electric circuits or the like on which the coil component 1 is incorporated and cause electrical shorting.

Also, according to the coil component 1, by constructing the second bobbin member 2*b* so as to include the insulating plate 12*b* as a second insulator disposed on the second coil member 3*b*, it is possible to insulate the second coil member 3*b*, so that even when electrical components or the like are disposed in the vicinity of the second coil member 3*b* when the coil component 1 is incorporated for example, it is possible to reliably prevent electrical shorting between the second coil member 3*b* and such electrical components and the like without having to separately attach an insulator.

Also, according to the coil component 1, parts of the respective edges of the insulating plates 12*a* and 12*b* are connected by the side wall 12*c* in a state where the insulating plates 12*a* and 12*b* face each other at a distance to produce an integrated structure, which makes it possible to sandwich the second coil member 3*b* with the insulating plates 12*a* and 12*b*. As a result, it is possible to collectively dispose the insulating plates 12*a* and 12*b* and the second coil member 3*b* on the first coil member 3*a* in a state where the second coil member 3*b* is sandwiched by the insulating plates 12*a* and 12*b*. Therefore, according to the coil component 1, it is possible to further improve the assembly efficiency. In addition, according to the coil component 1, since it is possible to surround (cover) the second coil member 3*b* using the side wall 12*c*, even when electrical components or the like are disposed in the vicinity of the second coil member 3*b* when the coil component 1 is incorporated for example, it is possible to reliably prevent electrical shorting between the second coil member 3*b* and such electrical components or the like without having to separately attach insulating materials.

According to the coil component 1, by having the support 11*c* function as the first positioner that positions the first coil member 3*a* and the second positioner that positions the second coil member 3*b*, compared to a configuration that is provided with a first positioner and a second positioner separately to the support 11*c*, it is possible to simplify the construction. Since it is possible to position the coil members 3*a* and 3*b* by merely supporting the joining portions 43*a* and 43*b* with the support 11*c* (i.e., fitting the joining portions 43*a* and 43*b* onto the support 11*c*), it is possible to further improve the assembly efficiency.

According to the coil component 1, by configuring the first bobbin member 2*a* so as to include the projecting portions 11*d* as third positioners that position the core 4*a*, it is possible to position the core 4*a* by merely attaching the core 4*a* to the first bobbin member 2*a*, which means that it is possible to sufficiently improve the assembly efficiency of the coil component 1 that includes the cores 4*a* and 4*b*.

According to the coil component 1, by constructing the second bobbin member 2*b* so as to include the projecting portions 32*a*, 32*b*, and 32*c* as fourth positioners that position the core 4*b*, it is possible to position the core 4*b* by merely attaching the core 4*b* to the second bobbin member 2*b*, which makes it possible to further improve the assembly efficiency of the coil component 1 that includes the cores 4*a* and 4*b*. Also according to the coil component 1, it is possible to keep both the cores 4*a* and 4*b* in the positioned state using the projecting portions 11*d* as the third positioners and the projecting portions 32*a*, 32*b*, and 32*c* as the fourth positioners. This means that according to the coil component 1, there are many variations to the assembly method, such as an assembly method where coil components 1 are stocked in advance in a state where the cores 4*a* and 4*b* have been attached to the bobbin 2 (a sub-assembly stage) and the stocked coil components 1 are disposed on electrical circuits or the like and an assembly method that attaches the cores 4*a* and 4*b* to the bobbin 2 immediately before the coil component 1 is disposed on electrical circuits or the like. By selecting an appropriate assembly method with consideration to other processes, it is possible to further improve the assembly efficiency. Also, according to the coil component 1, since it is possible to position both the cores 4*a* and 4*b*, it is possible to omit a process that prevents displacement by fixing the cores 4*a* and 4*b* using adhesive tape or the like which is necessary for configurations that lack a function that positions both of the cores 4*a* and 4*b*. As a result, it is possible to further improve the assembly efficiency of the coil component 1 that includes the cores 4*a* and 4*b*.

Figure 19:
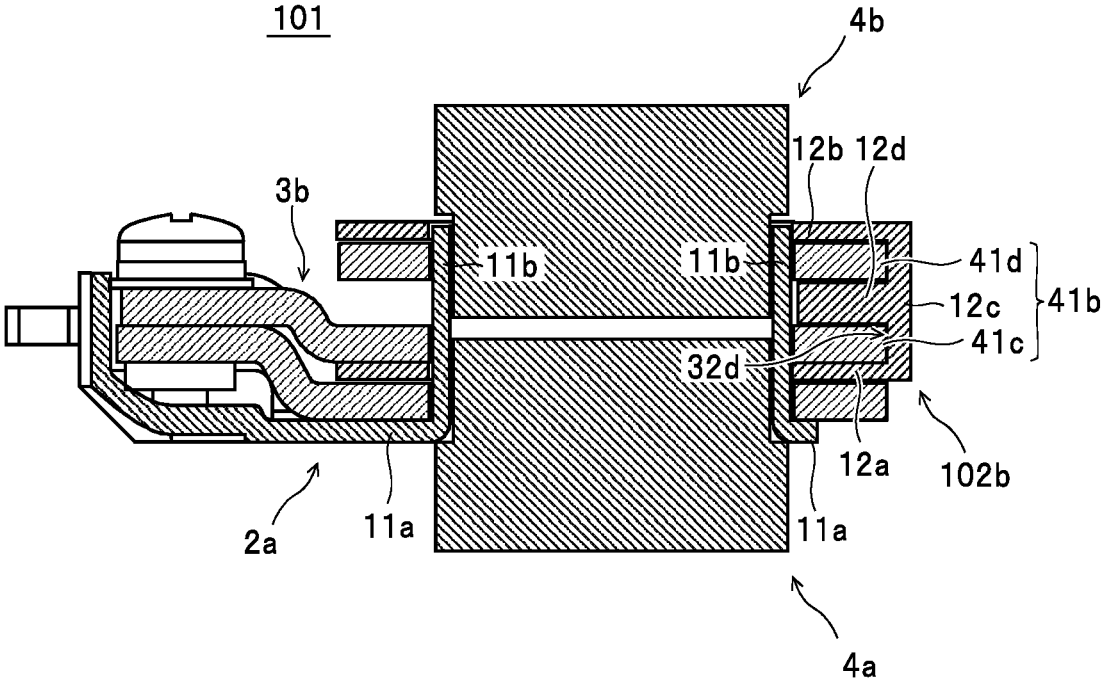
FIG. 19 is a cross-sectional view of the coil component 101 that has been cut on a plane X in FIG. 1.

A coil component according to the present invention is not limited to the configuration of the coil component 1 described above. As one example, it is also possible to apply the present invention to a coil component 101 depicted in FIG. 19. Note that in the following description, component elements that are the same as the component elements of the coil component 1 described above have been assigned the same reference numerals and duplicated description thereof is omitted. In place of the second bobbin member 2*b* of the coil component 1 described above, the coil component 101 includes a second bobbin member 102*b*. As depicted in FIG. 19, the second bobbin member 102*b* includes a non-conductive holding portion 12*d* formed in a flange shape (plate shape) that protrudes from an inner circumferential surface 32*d* of the side wall 12*c*. Here, as depicted in FIG. 19, the holding portion 12*d* is inserted between two ring-shaped portions 41*c* and 41*d* that compose a main body 41*b* of the second coil member 3*b* and face each other at a distance, and functions so as to hold the ring-shaped portions 41*c* and 41*d* in the separated state. According to the coil component 101, by configuring the second bobbin member 102*b* so as to include the holding portion 12*d*, it is possible to reliably hold the ring-shaped portions 41*c* and 41*d* in the separated state, which means that it is possible to reliably prevent a situation where the electrical properties change due to the ring-shaped portions 41*c* and 41*d* coming into contact.

Also, although an example configuration where the fourth positioners (i.e., the projecting portions 32*a*, 32*b*, and 32*c*) provided on the second bobbin member 2*b* position the core 4*b* has been described, it is also possible to apply the present invention to a configuration where the projecting portions 11*d* as the third positioner function so as to position both the cores 4*a* and 4*b*. With this configuration, by extending the projecting portions 11*d* upward, it becomes possible, when attaching the core 4*b*, for the ends of the side portions 53*a* of the core 4*b* to contact the projecting portions 11*d* and thereby position the core 4*b*. Since this configuration makes the fourth positioning portions of the second bobbin member 2*b* unnecessary, it is possible to simplify the configuration of the second bobbin member 2*b* to a corresponding degree.

Although an example where the coil 3 is constructed of the arc-shaped first coil member 3*a* and the spiral-shaped second coil member 3*b* has been described above, it is also possible to apply the present invention to a coil 3 that includes a spiral-shaped first coil member 3*a* and an arc-shaped second coil member 3*b*, to a coil 3 where both the coil members 3*a* and 3*b* are arc-shaped, and to a coil 3 where both the coil members 3*a* and 3*b* are spiral-shaped.

Although an example where the support 11*c* functions as both the first positioner and the second positioner has been described above, it is also possible to apply the present invention to a configuration where the first positioner and the second positioner are provided separately to the support 11*c*. When doing so, it is possible to have a single positioner function as the first positioner and the second positioner, or the first positioner and the second positioner may be separate.

Although an example where the insulating plates 12*a* and 12*b* are integrated by being connected by the side wall 12*c* has been described above, the insulating plates 12*a* and 12*b* may be separately constructed. It is also possible to construct the second bobbin member 2*b* of only the insulating plate 12*a* without the insulating plate 12*b* being provided.

Moreover, the invention encompasses any possible combination of some or all of the various embodiments and the modification examples described herein and incorporated herein.

It is possible to achieve at least the following configurations from the above-described example embodiments and the modification examples of the disclosure.

(1) A coil component comprising:

a non-conductive bobbin; and a coil that winds around the bobbin, wherein the coil includes:

a first coil member with a first main body, which is formed in one of an arc shape and a spiral shape, and a first joint, which is provided at one end of the first main body and in which a first joining hole is formed; and a second coil member with a second main body, which is formed in one of an arc shape and a spiral shape, and a second joint, which is provided at one end of the second main body and in which a second joining hole is formed, wherein the second coil member is electrically connected to the first coil member via a screw that is inserted through the first and second joining holes of the first and second joints, the bobbin includes a first bobbin member and a second bobbin member, the first bobbin member includes: a base plate that has a first opening formed in a central portion thereof; a barrel that is erected on the base plate so as to connect to the first opening; a first positioner that positions the first coil member when the first coil member is moved along a center axis of the barrel from a front end of the barrel toward the base plate; a second positioner that positions the second coil member when the second coil member is moved along the center axis from the front end of the barrel toward the base plate; and a support that is provided on the base plate and is formed so as to surround and support lower portions of the first and second joints of the first and second coil members, the second bobbin member includes a first insulator that is plate-shaped, has a second opening formed in a central portion thereof, and is disposed between the first and second coil members to insulate the first and second coil members from each other, the first coil member is positioned by the first positioner in a state where the barrel is inserted through the first main body and the first coil member is disposed on the base plate, and the first joint is supported by the support, the first insulator is disposed on the first coil member in a state where the barrel has been inserted through the second opening, and the second coil member is positioned by the second positioner in a state where the barrel is inserted through the second main body and the second coil member is disposed on the first insulator, and the second joint is supported by the support.

(2) The coil component according to (1), wherein the second bobbin member includes a second insulator that is plate-shaped and has a third opening in a central portion thereof, and the second insulator is disposed on the second coil member in a state where the barrel has been inserted through the third opening.

(3) The coil component according to (2), wherein the first and second insulators face each other at a distance and are integrated due to parts of edges of the first and second insulators being connected by a side wall.

(4) The coil component according to (3), wherein the second main body is formed in a spiral shape and has two rings that face each other at a distance, and the second bobbin member includes a non-conductive holder that is formed in a flange shape that protrudes from an inner surface of the side wall, is inserted between the rings, and holds the rings in a separated state.

(5) The coil component according to any of (1) to (4), wherein the support functions as the first positioner and the second positioner.

(6) The coil component according to any of (1) to (5), further comprising:

a first core that has a first pillar inserted into a base end side of the barrel; and a second core that has a second pillar inserted into the front end side of the barrel, wherein the first bobbin member includes a third positioner that positions the first core.

(7) The coil component according to (6), wherein the second bobbin member includes a fourth positioner that positions the second core.

(8) The coil component according to (6), wherein the third positioner positions the second core.

What is claimed is:

1. A coil component comprising:

a non-conductive bobbin; and a coil that winds around the bobbin, wherein the coil includes:

a first coil member with a first main body, which is formed in one of an arc shape and a spiral shape, and a first joint, which is provided at one end of the first main body and in which a first joining hole is formed; and a second coil member with a second main body, which is formed in one of an arc shape and a spiral shape, and a second joint, which is provided at one end of the second main body and in which a second joining hole is formed, wherein the second coil member is electrically connected to the first coil member via a screw that is inserted through the first and second joining holes of the first and second joints, the bobbin includes a first bobbin member and a second bobbin member, the first bobbin member includes: a base plate that has a first opening formed in a central portion thereof; a barrel that is erected on the base plate so as to connect to the first opening; a first positioner that positions the first coil member when the first coil member is moved along a center axis of the barrel from a front end of the barrel toward the base plate; a second positioner that positions the second coil member when the second coil member is moved along the center axis from the front end of the barrel toward the base plate; and a support that is provided on the base plate and is formed so as to surround and support lower portions of the first and second joints of the first and second coil members, the second bobbin member includes a first insulator that is plate-shaped, has a second opening formed in a central portion thereof, and is disposed between the first and second coil members to insulate the first and second coil members from each other, the first coil member is positioned by the first positioner in a state where the barrel is inserted through the first main body and the first coil member is disposed on the base plate, and the first joint is supported by the support, the first insulator is disposed on the first coil member in a state where the barrel has been inserted through the second opening, and the second coil member is positioned by the second positioner in a state where the barrel is inserted through the second main body and the second coil member is disposed on the first insulator, and the second joint is supported by the support.

2. The coil component according to claim 1, wherein the second bobbin member includes a second insulator that is plate-shaped and has a third opening in a central portion thereof, and the second insulator is disposed on the second coil member in a state where the barrel has been inserted through the third opening.

3. The coil component according to claim 2, wherein the first and second insulators face each other at a distance and are integrated due to parts of edges of the first and second insulators being connected by a side wall.

4. The coil component according to claim 3, wherein the second main body is formed in a spiral shape and has two rings that face each other at a distance, and the second bobbin member includes a non-conductive holder that is formed in a flange shape that protrudes from an inner surface of the side wall, is inserted between the rings, and holds the rings in a separated state.

5. The coil component according to claim 1, wherein the support functions as the first positioner and the second positioner.

6. The coil component according to claim 2, wherein the support functions as the first positioner and the second positioner.

7. The coil component according to claim 3, wherein the support functions as the first positioner and the second positioner.

8. The coil component according to claim 4, wherein the support functions as the first positioner and the second positioner.

9. The coil component according to claim 1, further comprising:

a first core that has a first pillar inserted into a base end side of the barrel; and a second core that has a second pillar inserted into the front end side of the barrel, wherein the first bobbin member includes a third positioner that positions the first core.

10. The coil component according to claim 2, further comprising:

a first core that has a first pillar inserted into a base end side of the barrel; and a second core that has a second pillar inserted into the front end side of the barrel, wherein the first bobbin member includes a third positioner that positions the first core.

11. The coil component according to claim 3, further comprising:

a first core that has a first pillar inserted into a base end side of the barrel; and a second core that has a second pillar inserted into the front end side of the barrel, wherein the first bobbin member includes a third positioner that positions the first core.

12. The coil component according to claim 4, further comprising:

a first core that has a first pillar inserted into a base end side of the barrel; and a second core that has a second pillar inserted into the front end side of the barrel, wherein the first bobbin member includes a third positioner that positions the first core.

13. The coil component according to claim 5, further comprising:

a first core that has a first pillar inserted into a base end side of the barrel; and a second core that has a second pillar inserted into the front end side of the barrel, wherein the first bobbin member includes a third positioner that positions the first core.

14. The coil component according to claim 6, further comprising:

a first core that has a first pillar inserted into a base end side of the barrel; and a second core that has a second pillar inserted into the front end side of the barrel, wherein the first bobbin member includes a third positioner that positions the first core.

15. The coil component according to claim 7, further comprising:

a first core that has a first pillar inserted into a base end side of the barrel; and a second core that has a second pillar inserted into the front end side of the barrel, wherein the first bobbin member includes a third positioner that positions the first core.

16. The coil component according to claim 8, further comprising:

a first core that has a first pillar inserted into a base end side of the barrel; and a second core that has a second pillar inserted into the front end side of the barrel, wherein the first bobbin member includes a third positioner that positions the first core.

17. The coil component according to claim 9, wherein the second bobbin member includes a fourth positioner that positions the second core.

18. The coil component according to claim 10, wherein the second bobbin member includes a fourth positioner that positions the second core.

19. The coil component according to claim 9, wherein the third positioner positions the second core.

20. The coil component according to claim 10, wherein the third positioner positions the second core.

* * * * *